United States Patent [19]

Hellyer et al.

[11] 4,133,779

[45] Jan. 9, 1979

[54] DETERGENT COMPOSITION CONTAINING SEMI-POLAR NONIONIC DETERGENT AND ALKALINE EARTH METAL ANIONIC DETERGENT

[75] Inventors: James A. Hellyer, Milford; David S. Lambert; Robert Mermelstein, both of Cincinnati, all of Ohio

[73] Assignee: The Procter & Gamble Company, Cincinnati, Ohio

[21] Appl. No.: 669,531

[22] Filed: Mar. 23, 1976

Related U.S. Application Data

[63] Continuation-in-part of Ser. No. 538,618, Jan. 6, 1975, abandoned, and Ser. No. 634,389, Nov. 24, 1975, abandoned.

[51] Int. Cl.[2] ..... C11D 1/83; C11D 1/12; C11D 1/75

[52] U.S. Cl. ..... 252/547; 252/548; 252/553; 252/559; 252/153

[58] Field of Search ..... 252/545, 547, 548, 553, 252/559, 153, 540

[56] References Cited

U.S. PATENT DOCUMENTS

| | | | |
|---|---|---|---|
| 3,332,875 | 7/1967 | Kessler et al. | 252/547 |
| 3,663,445 | 5/1972 | Augustin et al. | 252/547 X |
| 3,686,098 | 8/1972 | Weil | 252/554 |
| 3,809,659 | 5/1974 | Gerecht | 252/547 |
| 3,812,041 | 5/1974 | Inamorato | 252/89 |
| 3,812,044 | 5/1974 | Connor et al. | 252/547 X |
| 3,869,399 | 3/1975 | Collins | 252/545 X |

*Primary Examiner*—George F. Lesmes
*Assistant Examiner*—E. Rollins Buffalow
*Attorney, Agent, or Firm*—Robert B. Aylor; Richard C. Witte; Thomas H. O'Flaherty

[57] ABSTRACT

A detergent composition containing a semi-polar nonionic detergent and an alkaline earth metal salt of an anionic detergent in a ratio of from 1:100 to 1:2. The composition is especially useful for the removal of greasy soils.

20 Claims, No Drawings

DETERGENT COMPOSITION CONTAINING SEMI-POLAR NONIONIC DETERGENT AND ALKALINE EARTH METAL ANIONIC DETERGENT

REFERENCE TO RELATED APPLICATIONS

This application is a continuation-in-part of our patent applications for DETERGENT COMPOSITION CONTAINING SEMI-POLAR NONIONIC DETERGENT AND ALKALINE EARTH METAL ANIONIC DETERGENT, Ser. No. 538,618, filed Jan. 6, 1975, now abandoned and our copending application for DETERGENT COMPOSITION CONTAINING SEMI-POLAR NONIONIC DETERGENT AND ALKALINE EARTH METAL ANIONIC DETERGENT, Ser. No. 634,389, filed Nov. 24, 1975 now abandoned.

BACKGROUND OF THE INVENTION

This invention relates to a detergent composition especially formulated for the removal of greasy soils. More particularly, it relates to a detergent composition containing a semi-polar nonionic detergent and an alkaline earth metal salt of an anionic detergent.

Detergent compositions containing a wide variety of water-soluble organic detergents or mixtures thereof have been formulated. Recognizably, certain water-soluble organic detergents are better at removing one type of soil than other detergents. For example, anionic detergents are noted for their ability to remove carbohydrate and protein type stains, while nonionic detergents are especially useful in the removal of grease and oil stains. Various mixtures of detergents have been tried in order to find the optimum combination for removing a wide variety of stains as is normally encountered on soiled articles. (See for example, U.S. Pats. Nos. 2,691,636, 3,085,982, 3,177,598, 3,179,599, 3,192,166 and 3,223,647 for various organic detergent combinations.) However, there is a continuing need for detergent compositions that are effective in removing soils, especially greasy soils.

Additionally, various salts such as magnesium and calcium chloride and magnesium sulfate have been suggested as detergent composition additives for improving their detergency (see U.S. Pat. Nos. 2,908,651 and 2,437,253).

It has now been found that a detergent composition especially effective in the removal of greasy soil is formulated using a semi-polar nonionic detergent and an alkaline earth metal salt of certain anionic detergents.

It is accordingly an object of this invention to provide a detergent composition useful in the removal of greasy soils.

It is another object of this invention to provide a detergent composition containing a semi-polar nonionic detergent and an anionic detergent.

Still another object of this invention is to provide a liquid detergent composition containing a semi-polar nonionic detergent and an alkaline earth metal salt of an anionic detergent which is especialy efficient in removing greasy soils.

These and other objects will become apparent from the description to follow.

As used herein, all percentages and ratios are by weight unless otherwise indicated.

SUMMARY OF THE INVENTION

A detergent composition especially effective in removing greasy soils wherein the organic detergent portion of said composition consists essentially of a mixture of:

(a) a semi-polar organic nonionic detergent selected from the group consisting of (1) water-soluble amine oxides having one alkyl or hydroxyalkyl moiety of 8 to 28 carbon atoms and two alkyl moieties selected from the group consisting of alkyl groups and hydroxyalkyl groups of 1 to 3 carbon atoms, (2) water-soluble phosphine oxides having one alkyl or hydroxyalkyl moiety of 8 to 28 carbon atoms and two alkyl moieties selected from the group consisting of alkyl groups and hydroxyalkyl groups of 1 to 3 carbon atoms, (3) water-soluble sulfoxides having one alkyl or hydroxyalkyl moiety of 8 to 18 carbon atoms and an alkyl moiety selected from the group consisting of alkyl and hydroxyalkyl groups of 1 to 3 carbon atoms, and (4) mixtures thereof; and (b) an alkaline earth metal salt of an anionic detergent selected from the group consisting of (1) linear alkyl benzene sulfonates having 9 to 15 carbon atoms in the alkyl group, (2) alkyl sulfates having 8 to 22 carbon atoms, (3) paraffin sulfonates having 8 to 22 carbon atoms, (4) olefin sulfonates having 8 to 22 carbon atoms, (5) alkyl ether sulfates having 8 to 22 carbon atoms in the alkyl group and 1 to 30 ethylene oxide units (6) alkyl glyceryl ether sulfonates having 8 to 22 carbon atoms in the alkyl group and (7) mixtures thereof in a weight ratio of semi-polar nonionic detergent to anionic detergent of from 1:100 to 1:2.

DETAILED DESCRIPTION OF THE INVENTION

The detergent compositions of this invention contain a water-soluble semi-polar nonionic detergent and an alkaline earth metal salt of an anionic detergent as essential ingredients. Descriptions of these detergents follow.

Semi-polar nonionic detergents useful herein include water-soluble amine oxides, phosphine oxides and sulfoxides. The amine oxide has one alkyl or hydroxyalkyl moiety of 8to 28 carbon atoms, preferably 8 to 16 carbon atoms and two alkyl moieties selected from the group consisting of alkyl groups and hydroxyalkyl groups containing 1 to 3 carbon atoms. Examples of such materials include dimethyloctylamine oxide, diethyldecylamine oxide, bis-(2-hydroxyethyl) dodecylamine oxide, dimethyldodecylamine oxide, dipropyltetradecylamine oxide, methylethylhexadecylamine oxide, and dimethyl-2-hydroxyoctadecylamine oxide.

Suitable semi-polar nonionic detergents also include the water-soluble phosphine oxides having one alkyl or hydroxyalkyl moiety of 8 to 28 carbon atoms, preferably 8 to 16 carbon atoms and two alkyl moieties selected from the group consisting of alkyl groups and hydroxyalkyl groups containing 1 to 3 carbon atoms. Examples of suitable phosphine oxides include dimethyldecylphosphine oxide, dimethyltetradecylphosphine oxide, methylethyltetradecylphosphine oxide, dimethylhexadecylphosphine oxide, diethyl-2-hydroxyoctyldecylphosphine oxide, bis(2-hydroxyethyl) dodecylphosphine oxide, and bis(hydroxymethyl) tetradecylphosphine oxide.

The water-soluble sulfoxide detergents contain one alkyl or hydroxyalkyl moiety of 8 to 18 carbon atoms, preferably 12 to 16 carbon atoms and one alkyl moiety selected from the group consisting of alkyl and hydroxyalkyl groups having 1 to 3 carbon atoms. Specific examples of these sulfoxides include dodecylmethyl sulfoxide, 2-hydroxyethyltridecyl sulfoxide, hexadecylmethyl sulfoxide, 3-hydroxyoctadecylethyl sulfoxide.

The anionic detergent is an alkaline earth metal salt of an organic anionic detergent. Especially preferred salts are the calcium and magnesium salts. The anionic detergent salt which is useful in the present invention is selected from the following classes of anionic detergents:

(1) Alkyl benzenes sulfonates in which the alkyl group contains from 9 to 15 carbon atoms, preferably 11 to 14 carbon atoms in straight chain or branched chain configuration. An especially preferred linear alkyl benzene sulfonate contains 12 carbon atoms. U.S. Pat. Nos. 2,220,099 and 2,477,383 describe these detergents.

(2) Alkyl sulfates obtained by sulfating an alcohol having 8 to 22 carbon atoms, preferably 12 to 16 carbon atoms. The alkyl sulfates have the formula $(ROSO_3)_2M$ where R is the $C_{8-22}$ alkyl group and M is the alkaline earth metal.

(3) Paraffin sulfonates having 8 to 22 carbon atoms, preferably 12 to 16 carbon atoms in the alkyl moiety;

(4) Olefin sulfonates having 8 to 22 carbon atoms, preferably 12 to 16 carbon atoms. U.S. Pat. No. 3,332,880 contains a description of suitable olefin sulfonates.

(5) Alkyl ether sulfates derived from ethoxylating an alcohol having 8 to 22 carbon atoms, preferably 12 to 16 carbon atoms with 1 to 30, preferably 1 to 12 moles of ethylene oxide. The alkyl ether sulfates having the formula $$[RO(C_2H_4O)_x\,SO_3]_2M$$

where R is the $C_{8-22}$ alkyl group, x is 1–30, and M is an alkaline earth metal.

(6) Alkyl glyceryl ether sulfonates having 8 to 22 carbon atoms, preferably 12 to 16 carbon atoms in the alkyl moiety; and (7) Mixtures thereof.

The above-described anionic detergents are all available commercially. The acid form of the anionic detergent may be converted to the alkaline earth metal salt form either prior to admixture with the semi-polar nonionic detergent or thereafter. This conversion can be accomplished either by direct neutralization with an alkaline earth metal base or by ion exchange between, e.g., an alkali metal, ammonium or alkanolammonium salt of the anionic detergent and a non-toxic, water-soluble alkaline earth metal salt. Preferably, a source of magnesium or calcium ions is added to the detergent mixture under desirable reaction conditions to form the desired salts. Calcium and magnesium chlorides, calcium and magnesium sulfates, calcium and magnesium acetates or calcium and magnesium hydroxides are examples of magnesium and calcium sources. Magnesium chloride and magnesium sulfate are preferred.

The cation of the anionic detergent is important in that the alkaline earth metal salts of the hereindescribed anionic detergent perform better in terms of grease removal than the alkali metal, ammonium or alkanolammonium salts of said anionic detergents when in combination with the semi-polar nonionic detergent. In some cases, a mixture of cations may be desirable for optimum physical properties or sudsing across a range of conditions and soils, provided sufficient amounts of the anionic surfactant are in the alkaline earth metal form to provide the desired grease removal. Up to about 25% of the above anionic detergents can be in the form of their sodium, potassium, ammonium, mono-, di-, or triethanolammonium salts, especially ammonium, monoethanolammonium, or triethanolammonium.

It will be recognized that the alkyl groups for the above detergents can be derived from either natural or synthetic sources, e.g., they can be derived from naturally occurring fatty acids; olefins such as those prepared by Ziegler, or Oxo processes; or from olefins separated from petroleum either with or without "cracking". Specific examples, e.g., of alkyl sulfates and alkyl ether sulfates include those derived from Neodol 23 which is a synthetic alcohol prepared by an Oxo process and containing about 42 weight percent of dodecanol and about 54 weight percent of tridecanol.

A ratio of semi-polar nonionic detergent to anionic detergent (salt basis) of 1:100 to 1:2, preferably 1:15 to 1:3 provides very satisfactory grease removal. The degree of grease removal obtained from the detergent mixture is greater than that achieved from either of the individual detergents alone when used under normal conditions.

The detergent compositions of this invention are formulated in powder, granular, tablet, paste, or liquid form. Regardless of the form of the composition, it is especially effective in the removal of greasy soils.

A preferred detergent composition containing the above-described detergents is in a liquid form. Such liquid compositions are especially useful for the hand washing of soiled cooking utensils and tableware. The liquid compositions contain from 1% to 45%, preferably 10% to 35% for concentrated products designed for dilution prior to use and preferably 2% to 15% for products designed for use "as is", of the semi-polar nonionic and anionic detergent mixture. The balance of the formula comprises water. All manner of known additives may be included in the liquid composition. For example, suds boosters, organic solvents, e.g., $C_1$-$C_5$ alkanols (preferably ethanol), perfumes, dyes, and hydrotropes may be added for their known functions.

An especially preferred liquid detergent composition also contains a source of alkalinity for increased greasy soil removal. Sodium hydroxide, potassium hydroxide, ammonium hydroxide, and mono-, di- or trialkanolamines wherein said alkanol moieties contain from one to five, preferably two to three carbon atoms, in either a linear or branched configuration are suitable bases. Normally, the higher chain length branched alkanolamines are mono- or di-substituted. Common alkanolamines are mono- and diisopropanolamins and mono-, di- and triethanolamines. Sufficient base is added to the composition to raise its pH to above 7.0, but below 9.0. Such a composition has not only increased soil removal ability, but also the removal is accelerated. Mono-, di- and triethanolamines and mixtures thereof are preferred sources of alkalinity because of the resultant compositions' physical characteristics, i.e., the compositions have good fluidity and viscosity.

A liquid detergent composition having the following formulation is most preferred:

(a) from 2% to 6% of a water-soluble amine oxide having one alkyl moiety of 8 to 16 carbon atoms and two alkyl moieties of 1 to 3 carbon atoms;

(b) from 10% to 30% of a calcium or magnesium, preferably magnesium, alkyl sulfate having 12 to 16 carbon atoms;

(c) from 0% to 20% of a calcium or magnesium, preferably magnesium, alkyl ether sulfate derived from an alcohol having 12 to 16 carbon atoms ethoxylated with 1 to 12 moles of ethylene oxide;

(d) from 0% to about 10% of ammonium, mono-, di-, or triethanolammonium alkyl ether sulfate derived from an alcohol having 12 to 16 carbon atoms ethoxylated with 1 to 12 moles of ethylene oxide;

(e) from 0% to 15% mono-, di- or triethanolammonium, or ammonium, preferably monoethanolammonium, sulfate or chloride or mixtures thereof;

(f) from 0% to 7% mono-, di- or triethanolamine or mixtures thereof, preferably monoethanolamine; and (g) the balance water or water and $C_1$-$C_5$ alkanol (preferably ethanol) mixtures.

More concentrated liquids and/or pastes containing from 45% to about 95% of said mixture of semi-polar nonionic and anionic detergents are also desirable.

The granular or tableted compositions of this invention contain from 5to 50% preferably 10% to 35% of the semi-polar nonionic and anionic detergent mixture. The balance of the composition comprises inert filler salts. A suitable inert filler salt is sodium sulfate. Various additives, e.g., suds suppressors, dyes, perfume, soil anti-redeposition agents, and water may also be included in the granular or tableted composition.

The liquid detergent compositions of this invention are preferably prepared by neutralizing the acid forms of the anionic detergent with the aforementioned sources of alkalinity, preferably monoethanolamine, triethanolamine or ammonium hydroxide, and then adding a soluble alkaline earth metal salt, preferably magnesium sulfate or magnesium chloride, to give the finished formula.

The examples which follow are illustrative of this invention.

EXAMPLE I

The following detergent compositions are formulated on a weight percent basis.

| | A | B | C | D | E | F | G | H | I | J | K | L |
|---|---|---|---|---|---|---|---|---|---|---|---|---|
| Sodium dodecyl benzene sulfonate | 22.0 | — | — | — | — | — | — | — | — | — | — | — |
| Magnesium dodecyl benzene sulfonate | — | 22.0 | — | — | — | — | — | — | — | — | — | — |
| Sodium coconut sulfate | — | — | 25.0 | — | — | — | — | — | — | — | — | — |
| Magnesium coconut sulfate | — | — | — | 25.0 | — | — | — | — | — | — | — | — |
| Sodium $C_{12}$ olefin sulfonate | — | — | — | — | 25.0 | — | — | — | — | — | — | — |
| Magnesium $C_{12}$ olefin sulfonate | — | — | — | — | — | 25.0 | — | — | — | — | — | |
| Sodium $C_{12}$ paraffin sulfonate | — | — | — | — | — | — | 26.0 | — | — | — | — | — |
| Magnesium $C_{12}$ paraffin sulfonate | — | — | — | — | — | — | — | 26.0 | — | — | — | — |
| Sodium salt of a sulfated coconut alcohol ethoxylated with 3 moles of ethoxylated oxide | — | — | — | — | — | — | — | — | 34.0 | — | — | — |
| Magnesium salt of a sulfated coconut alcohol ethoxylated with 3 moles of ethylene oxide | — | — | — | — | — | — | — | — | — | 34.0 | — | — |
| Sodium coconut glyceryl ether sulfonate | — | — | — | — | — | — | — | — | — | — | 30.0 | — |
| Magnesium coconut glyceryl ether sulfonate | — | — | — | — | — | — | — | — | — | — | | 30.0 |
| Dimethyldodecylamine oxide | 4.0 | 4.0 | 4.0 | 4.0 | 4.0 | 4.0 | 4.0 | 4.0 | 4.0 | 4.0 | 4.0 | 4.0 |
| Triethanolamine | 3.5 | 3.5 | 3.5 | 3.5 | 3.5 | 3.5 | 3.5 | 3.5 | 3.5 | 3.5 | 3.5 | 3.5 |
| Water | 63.0 | 63.0 | 60.0 | 60.0 | 60.0 | 60.0 | 59.0 | 59.0 | 51.0 | 51.0 | 55.0 | 55.0 |
| Ethanol | 5.0 | 5.0 | 5.0 | 5.0 | 5.0 | 5.0 | 5.0 | 5.0 | 5.0 | 5.0 | 5.0 | 5.0 |
| Misc. (perfume, dye, etc.) | balance | ← | | | | | | | | → | balance | |

Compositions A-L are tested for their ability to remove grease from a soiled surface. A preweighed 250 cc. polypropylene cup has 3 cc. of a melted beef grease applied to its inner bottom surface. After the grease has solidified, the cup is reweighed. Then a 1% aqueous solution of the composition to be tested is added to the cup to completely fill it. The aqueous solution has a temperature of 45° C. After 15 minutes, the cup is emptied and rinsed with distilled water. The cup is dried and then weighed to determine the amount of grease removal. The results of tests performed on the above compositions are reported as follows on a % grease removal basis.

| | % Grease Removal |
|---|---|
| Composition A | 10.0% |
| Composition B | 60.0% |
| Composition C | 18.0% |
| Composition D | 64.0% |
| Composition E | 30.0% |
| Composition F | 50.0% |
| Composition G | 33.0% |
| Composition H | 52.0% |
| Composition I | 2.0% |
| Composition J | 61.0% |
| Composition K | 6.0% |
| Composition L | 64.0% |

The above results show that the compositions of this invention, i.e. compositions B, D, F, H, J and L remove more grease than the similar compositions wherein the magnesium cation is not employed.

EXAMPLE II

The following compositions are formulated:

| | A | B | C | D | E | F |
|---|---|---|---|---|---|---|
| Magnesium salt of sulfated coconut alcohol ethoxylated with 6 moles of ethylene oxide | 0% | 6.0% | 6.0% | 8.0% | 8.0% | 6.0% |
| Magnesium coconut sulfate | 0% | 25.0% | 25.0% | 19.0% | 19.0% | 25.0% |
| Dimethyldodecylamine oxide | 4.0% | 0 % | 4.0% | 4.0% | 4.0% | 4.0% |
| Triethanolamine | 0% | 0 % | 0 % | 0 % | 3.5% | 3.5% |
| Sodium cumene sulfonate | 2.0% | 2.0% | 2.0% | 2.0% | 2.0% | 2.0% |
| Ethanol | 5.0% | 5.0% | 5.0% | 5.0% | 5.0% | 5.0% |
| Water | 88.5% | 61.5% | 57.5% | 61.5% | 58.0% | 54.0% |

EXAMPLE II-continued

| | The following compositions are formulated: | | | | | |
|---|---|---|---|---|---|---|
| | A | B | C | D | E | F |
| Misc. (perfume and dye) | balance | ← | | | → | balance |

The pH's of Compositions A, B, C, D, E and F and 7.0, 7.0, 7.0, 7.0, 8.5, and 8.5, respectively. When tested for grease removal in the manner described in Example I, the following results are obtained.

| | % Grease Removal |
|---|---|
| Composition A | 9.0% |
| Composition B | 20.0% |
| Composition C | 51.0% |
| Composition D | 36.0% |
| Composition E | 49.0% |
| Composition F | 64.0% |

The above results show that Compositions C-F have better grease removal properties than Compositions A and B. Additionally, the results show that the inclusion of triethanolamine in Compositions E and F provided an increased removal benefit versus similar Compositions D and C, respectively.

EXAMPLE III

When Compositions C-F of Example II are formulated with dimethyldodecylphosphine oxide replacing the amine oxide, substantially the same grease removal results are obtained.

EXAMPLE IV

When methyldodecylsulfoxide is used in place of the amine oxide of Compositions C-F of Example II, substantially the same grease removal benefits are obtained.

EXAMPLE V

The use of monoethanolamine, diethanolamine, and sodium and potassium hydroxide in place of the triethanolamine of Compositions E and F of Example II does not change the grease removal performance of the composition.

EXAMPLE VI

The following granular detergent composition also shows satisfactory grease removal performance.

Magnesium dodecyl benzene sulfonate: 17.0%
Diethyltetradecylamine oxide: 3.0%
Sodium sulfate: 50.0%
Water: 29.0%
Misc. (perfume, dye, etc.): balance

EXAMPLES VII, VIII, AND IX

The following liquid detergent compositions are especially effective from the standpoint of cleaning; Examples VII and IX are designed for use with dilution and Example VIII is to be used "as is".

| Component | Percent by Weight | | |
|---|---|---|---|
| | VII | VIII | IX |
| The magnesium salt of an alkyl sulfate having the following approximate chain distribution by weight %: 42% $C_{12}$; 54% $C_{13}$; 3% $C_{14}$; and 1% $C_{15}$ | 19.4 | 6.0 | 38.8 |
| The magnesium salt of the sulfate of a polyethoxylated (6.5) straight chain alcohol having the following approximate alkyl chain distribution by weight %: 42% $C_{12}$; 54% $C_{13}$; 3% $C_{14}$; and 1% $C_{15}$ | 6.6 | 2.0 | 13.2 |
| Dimethylalkylamine oxide wherein the alkyl group has the following approximate distribution by weight %: 65% $C_{12}$; 25% $C_{14}$; and 9% $C_{16}$ | 3.0 | 1.0 | 6.0 |
| Monoethanolammonium sulfate | 8.7 | 2.0 | 17.4 |
| Monoethanolamine | 0.2 | 0.2 | 0.4 |
| Water, perfume and other minors | Balance | Balance | Balance |
| pH of compositions - 8.1 | | | |

EXAMPLE X

| | Percent by wt. |
|---|---|
| The magnesium salt of the alkyl sulfate of Example IX | 13.0 |
| The magnesium salt of the sulfate of a polyethoxylated (3) straight chain alcohol having the following approximate alkyl chain distribution by 42% $C_{12}$; 54% $C_{13}$, 3% $C_{14}$; and 1% $C_{15}$ | 15.0 |
| The dimethyl alkylamine oxide of Example IX | 3.0 |
| Monoethanolamine sulfate | 9.0 |
| Monethanolamine | .06 |
| Ethanol | 5.0 |
| Water, perfume and other minors | |
| pH of composition 7.1 | |

EXAMPLE XI

| | Percent by wt. |
|---|---|
| The magnesium salt of the alkyl sulfate of Example X | 14.0 |
| The magnesium salt of the sulfate of a polyethoxylated alcohol of Example X | 11.5 |
| The ammonium salt of the sulfate of a polyethoxylated alcohol of Example X | 4.8 |
| The dimethyl alkylamine oxide of Example X | 3.0 |
| $NH_4Cl$ | 4.04 |
| Ethanol | 5.0 |
| Water, perfume, dye, and other minors | Balance |
| pH of composition 7.1 | |

What is claimed is:

1. A detergent composition especially effective in removing greasy soils consisting essentially of a mixture of:

(a) a water-soluble amine oxide having one alkyl or hydroxy alkyl moiety of 8 to 28 carbon atoms and two alkyl moieties selected from the group consisting of alkyl groups and hydroxy alkyl groups of 1 to 3 carbon atoms;

(b) a magnesium salt of an anionic detergent selected from the group consisting of (1) linear alkyl benzene sulfonates having 9 to 15 carbon atoms in the alkyl group, (2) alkyl sulfates having 8 to 22 carbon atoms, (4) olefin sulfonates having 8 to 22 carbon atoms, (5) alkyl ether sulfates having 8 to 22 carbon atoms in the alkyl group and 1 to 30 ethylene oxide units, (6) alkyl glyceryl ether sulfonates having 8 to 22 carbon atoms in the alkyl group and (7) mixtures thereof in a weight ratio of amide oxide to anionic detergent of from 1:100 to 1:2; and (c) the balance selected from the group consisting of water, mixtures of water and $C_1$-$C_5$ alkanols, and inert filler salts.

2. The detergent composition of claim 1 wherein the anionic detergent is a linear alkyl benzene sulfonate having 9 to 15 carbon atoms.

3. The detergent composition of claim 1 wherein the anionic detergent is an alkyl sulfate having 8 to 22 carbon atoms.

4. The detergent composition of claim 1 wherein the anionic detergent is a paraffin sulfonate having 8 to 22 carbon atoms.

5. The detergent composition of claim 1 wherein the anionic detergent is an olefin sulfonate having 8 to 22 carbon atoms.

6. The detergent composition of claim 1 wherein the anionic detergent is an alkyl ether sulfate derived from an alcohol having 8 to 22 carbon atoms ethoxylated with 1 to 30 moles of ethylene oxide.

7. The detergent composition of claim 1 wherein the anionic detergent is an alkyl glyceryl ether sulfonate having 8 to 22 carbon atoms in the alkyl group.

8. The detergent composition of claim 1 wherein the ratio of amide oxide to anionic detergent is from 1:15 to 1:3.

9. The detergent composition of claim 1 in a liquid form wherein the composition consists essentially of from 1% to 45% of said mixture, and the balance water or mixtures of water and $C_1$-$C_5$ alkanols.

10. The detergent composition of claim 9 additionally containing sufficient base to raise the pH of the composition to a pH above 7.0, but below 9.0.

11. The detergent composition of claim 10 wherein the base is monoethanolamine, diethanolamine, triethanolamine, or mixtures thereof.

12. The detergent composition of claim 11 wherein the base is monoethanolamine.

13. The detergent composition of claim 10 wherein the base is ammonium hydroxide.

14. The detergent composition of claim 11 wherein the composition has a pH of from 7.0 to 8.5.

15. The detergent composition of claim 1 in a solid form containing from 5% to 50% of the mixture and the balance inert filler salts.

16. The detergent composition of claim 1 in a liquid form wherein the composition consists essentially of from 10% to 35% of said mixture and the balance water or mixtures of water and ethanol.

17. The detergent composition of claim 1 in a liquid form wherein the composition consists essentially of from 2% to 15% of said mixture and the balance water or mixtures of water and ethanol.

18. A liquid detergent composition consisting essentially of:

(a) from 2% to 6% of a water-soluble amine oxide having one alkyl moiety of 8 to 16 carbon atoms and two alkyl moieties of 1 to 3 carbon atoms;

(b) from 10% to 30c/0 of a magnesium alkyl sulfate having 12 to 16 carbon atoms;

(c) from 0% to 20% of a magnesium alkyl ether sulfate derived from an alcohol having 12 to 16 carbon atoms ethoxylated with 1 to 12 moles of ethylene oxide;

(d) from 0% to 7% mono-, di-, or triethanolamine, or mixtures thereof;

(e) from 0% to 15% mono-, di-, or triethanolammonium sulfate, or mixtures thereof; and (f) the balance water or mixtures of water and $C_1$-$C_5$ alkanol.

19. The detergent composition of claim 18 wherein (b) is the magnesium alkyl sulfate, (c) is the magnesium alkyl ether sulfate, (d) is monoethanolamine, and (e) is monoethanolammonium sulfate.

20. A liquid detergent composition consisting essentially of:

(a) from 2% to 6% of a water-soluble amine oxide having one alkyl moiety of 8 to 16 carbon atoms; and two alkyl moieties of 1 to 3

(b) from 10% to 30% of a magnesium alkyl sulfate having 12 to 16 carbon atoms;

(c) from 0% to 20% of a magnesium alkyl ether sulfate derived from an alcohol having 12 to 16 carbon atoms ethoxylated with 1 to 12 moles of ethylene oxide;

(d) from 0% to about 10% of ammonium, mono-, di- or triethanolammonium alkyl ether sulfate derived from an alcohol having 12 to 16 carbon atom ethoxylated with 1 to 12 moles of ethylene oxide;

(e) from 0% to 7% mono-, di- or triethanolamine, or mixtures thereof;

(f) from 0% to 15% ammonium or mono-, di- or triethanolammonium sulfate or chloride, or mixtures thereof; and (g) the balance water of mixtures of water and $C_1$-$C_5$ alkanol.

* * * * *

UNITED STATES PATENT AND TRADEMARK OFFICE

CERTIFICATE OF CORRECTION

PATENT NO. : 4,133,779

DATED : January 9, 1979

INVENTOR(S) : James A. Hellyer, David S. Lambert, Robert Mermelstein

It is certified that error appears in the above-identified patent and that said Letters Patent are hereby corrected as shown below:

Column 9, line 2, after "atoms", please enter -- (3) paraffin sulfonates having 8 to 22 carbon atoms, --.

Signed and Sealed this

*Fourth* Day of *August 1981*

[SEAL]

*Attest:*

GERALD J. MOSSINGHOFF

*Attesting Officer*

*Commissioner of Patents and Trademarks*